US007472457B2

(12) United States Patent
Giovannetti

(10) Patent No.: US 7,472,457 B2
(45) Date of Patent: Jan. 6, 2009

(54) GUIDE AND SUPPORT DEVICE FOR A FURNITURE DOOR

(75) Inventor: Antonio Giovannetti, Segrate (IT)

(73) Assignee: Effegi Giovanetti, Segrate (MI) (IT)

( * ) Notice: Subject to any disclaimer, the term of this patent is extended or adjusted under 35 U.S.C. 154(b) by 356 days.

(21) Appl. No.: 11/314,526

(22) Filed: Dec. 22, 2005

(65) Prior Publication Data

US 2006/0157990 A1 Jul. 20, 2006

(30) Foreign Application Priority Data

Jan. 17, 2005 (IT) ..... MI2005A0043

(51) Int. Cl.
*E05F 1/08* (2006.01)

(52) U.S. Cl. ..... 16/78; 16/197

(58) Field of Classification Search ..... 16/197, 16/401, 78; 312/330.1, 333, 334.3; 49/199, 49/200, 325, 445–447, 429, 414, 453, 463; 292/262–264, DIG. 46; 296/50, 56, 146.8; 160/191–193, 201

See application file for complete search history.

(56) References Cited

U.S. PATENT DOCUMENTS

| | | | | | |
|---|---|---|---|---|---|
| 1,880,870 | A | * | 10/1932 | Demo | 16/78 |
| 2,473,125 | A | * | 6/1949 | Alexander | 187/400 |
| 3,150,905 | A | * | 9/1964 | Payton et al. | 312/276 |
| 3,516,636 | A | * | 6/1970 | Burke | 248/578 |
| 4,301,623 | A | * | 11/1981 | Demukai | 49/404 |
| 4,332,054 | A | * | 6/1982 | Paist et al. | 16/197 |
| 4,642,845 | A | * | 2/1987 | Marshik | 16/194 |
| 5,365,636 | A | * | 11/1994 | Jensen | 16/67 |
| 6,467,128 | B1 | * | 10/2002 | Damani | 16/197 |
| 6,735,820 | B1 | * | 5/2004 | Teutsch | 16/72 |

FOREIGN PATENT DOCUMENTS

| | | | | |
|---|---|---|---|---|
| EP | 189228 | A | * | 7/1986 |
| EP | 0 697 492 | A | | 2/1996 |
| GB | 703 594 | A | | 2/1954 |
| GB | 2 054 733 | A | | 2/1981 |
| JP | 07238754 | A | * | 9/1995 |
| JP | 08319754 | A | * | 12/1996 |
| JP | 10317789 | A | * | 12/1998 |

OTHER PUBLICATIONS

European Search Report dated May 4, 2006.

* cited by examiner

*Primary Examiner*—Chuck Y. Mah
(74) *Attorney, Agent, or Firm*—Nixon & Vanderhye, PC

(57) ABSTRACT

A guide and support device (1) for the door (7) of an item of furniture (13) is described, comprising a support (2)—which carries at least one body (3), a second body (4) slidable on the support (2) and a spring (5) placed between the first and the second body (3, 4)—and a cable (6), having one end fixed to the door (7) and the other end fixed to the support (2), which slides at least in a first pulley (8) carried by the second body (4).

Preferably, the first body (3) also carries a second pulley (9), at least the first pulley (8) carried by the second body (4) is a multiple pulley and the cable (6) passes in the races of both pulleys (8, 9).

The first body (3) advantageously comprises means (10, 11) able to adjust the position thereof at the time of installation of the device (1).

13 Claims, 2 Drawing Sheets

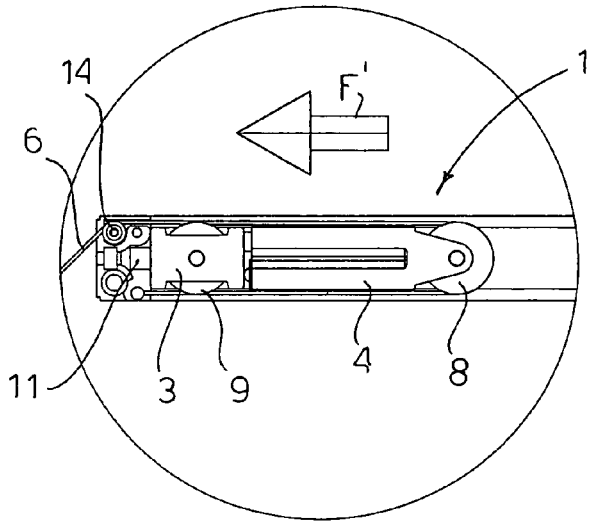
FIG. 3
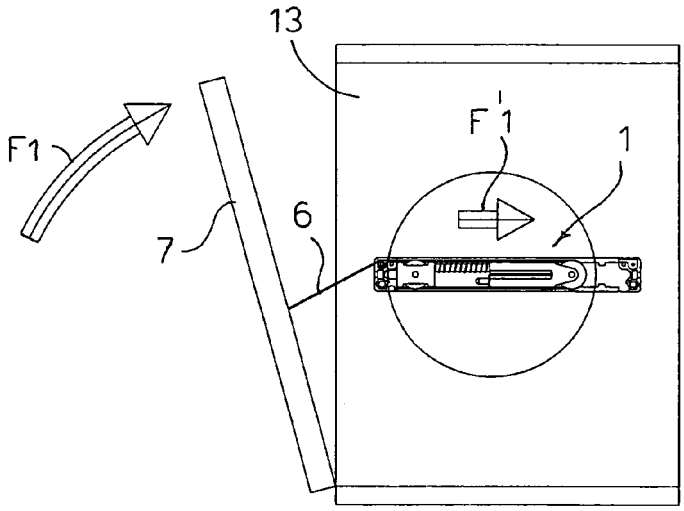
FIG. 4
FIG. 5
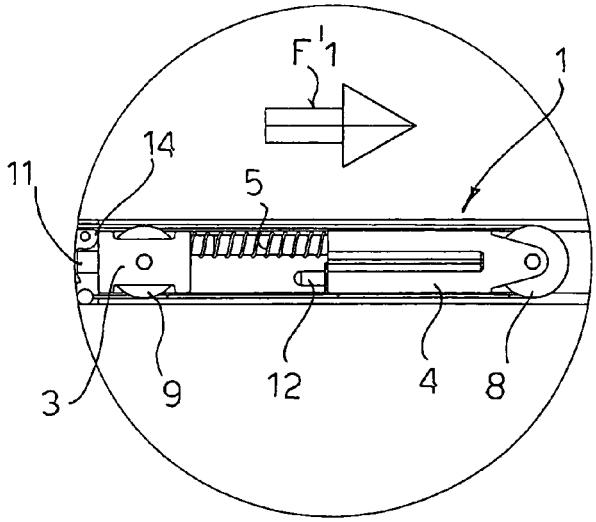

GUIDE AND SUPPORT DEVICE FOR A FURNITURE DOOR

BACKGROUND OF THE INVENTION

1. Field of the Invention

The present invention refers to a guide and support device for a furniture door, designed to support the door when it is open (that is, when it is practically horizontal) and to make the opening movement and the closing movement of said door gradual.

2. Description of Related Art

Many types of guide and support devices are known in the art, ranging from cables or chains (suitable only for supporting the door when it is open) to devices comprising pairs of rods, frictionally movable with respect to one another, which are designed to make the door opening movement gradual.

There is currently a demand on the market for guide and support devices which, besides supporting the door when it is open and making the opening movement gradual, also make the door-closing movement easier and are more aesthetically pleasing than the devices of the prior art.

No guide and support devices are currently available that are able to meet the above-mentioned market demand, in particular making the closing of the door easier.

Object of the present invention is to produce a guide and support device that is able to meet the demands of the market, overcoming the limitations of the devices of the prior art; this object is achieved by means of a guide and support device having the characterizing features set forth herein.

BRIEF DESCRIPTION OF THE SEVERAL VIEWS OF THE DRAWINGS

The invention will now be described with reference to a purely exemplifying (and therefore non-limiting) embodiment illustrated in the appended figures, where:

FIG. 3 shows diagrammatically the detail highlighted in FIG. 2;

FIG. 4 shows diagrammatically the device of FIG. 1 applied to the inside wall of an item of furniture with the door in the closing stage;

FIG. 5 shows diagrammatically the detail highlighted in FIG. 4.

In the appended figures like elements will be denoted by the same reference numerals.

DETAILED DESCRIPTION OF THE INVENTION

Figure 1:
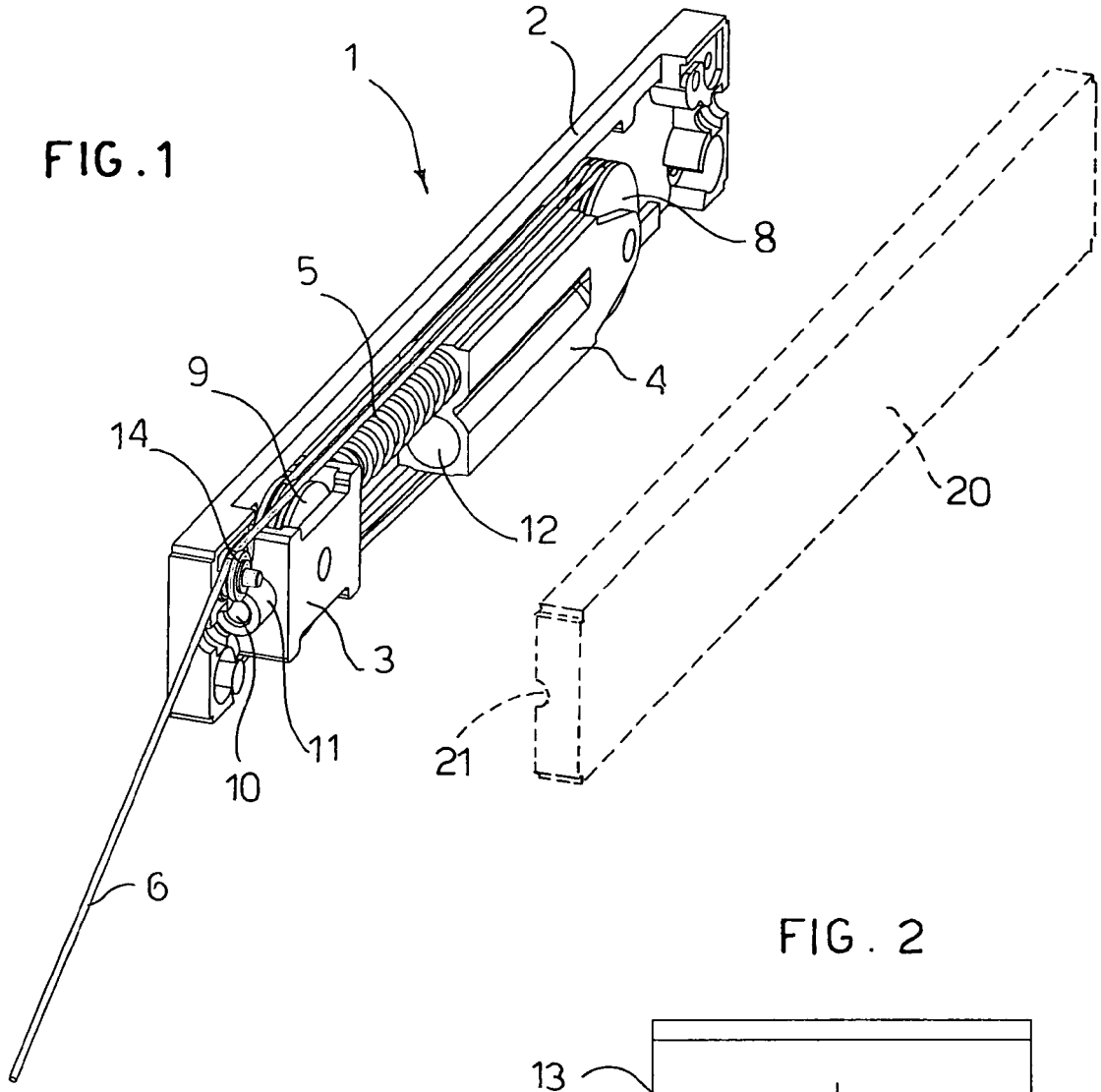
FIG. 1 shows diagrammatically a perspective view of a device according to the invention, without the covering element.

FIG. 1 shows diagrammatically a perspective view of a device according to the invention, denoted as a whole with the reference numeral 1, which comprises at least:

- a support 2, which carries at least a first body 3, a second body 4 slidable on the support 2, a spring 5 placed between the first and the second body (3, 4) and, preferably, an idler wheel 14 for a cable 6;
- the cable 6, having one end fixed to the door 7 of the item of furniture 13 (FIGS. 2 and 4) and the other end fixed to the support 2, which slides at least in a first pulley 8 carried by the second body 4.

In the preferred embodiment of the device 1 described herein, the first pulley 8 carried by the second body 4 is a pulley comprising at least two races, the first body 3 carries a second pulley 9 comprising at least one race and the cable 6 passes alternately in the races of the first and of the second pulley (8, 9).

This allows the cable 6 to be given the necessary length to support the open door 7 though maintaining limited the stroke of the second body 4 and, consequently, the length of the support 2 and of the device 1: in fact, if, as in the embodiment shown in FIG. 1, the first pulley 8 has two races and the second pulley 9 has at least one race, the stroke of the second body 4 is a quarter of the length of the cable 6 which comes out of and which returns into the device 1 during the opening and the closing, respectively, of the door 7.

The use of pulleys (8, 9) with a plurality of races also allows the action of the spring 5 to be made gentler and more gradual both during the compression and during the expansion thereof.

Furthermore, the second body 4 carries a shock absorber 12 (FIG. 5), acting on the first body 3, which prevents the second body 4 from hitting the first body 3 when the door 7 is completely open (FIGS. 2 and 3) and the second body 4 is adjacent to the first body 3;

the first body 3 comprises means suitable to adjust the position thereof at the time of the installation of the device 1: this allows the angle of aperture of the door 7 to be adjusted and small differences in position due to the type of hinge used and/or to small inaccuracies in the positioning of the device 1 and/or in the point of attachment of the cable 6 to the door 7 to be compensated for.

Said adjustment means comprise a screw 10 (advantageously a micrometric screw), fixed to the support 2, which acts on a threaded bush 11 integral with the first body 3.

The use of pulleys (8, 9) with a plurality of races allows a more precise adjustment of the position of the first body 3 by means of the above adjustment means (10, 11) since, in the same way as stated previously with reference to the second body 4, a small shift of the first body 3 leads to a greater change (for example quadruple) in the length of the cable 6 coming out of the device 1.

The device 1 further comprises a covering element 20, shown very diagrammatically in dashed lines in FIG. 1, fixed to the support 2 and presenting an opening 21, preferably situated level with the idler wheel 14, for the passage of the cable 6.

In the appended FIGS. 2 to 5 the covering element, which can also be designed to give a more pleasing appearance to the devices 1, has been omitted in order to show more clearly the structure and the operation of the device 1.

Operation of the device 1 will now be described with reference to FIGS. 2-4.

Figure 2:
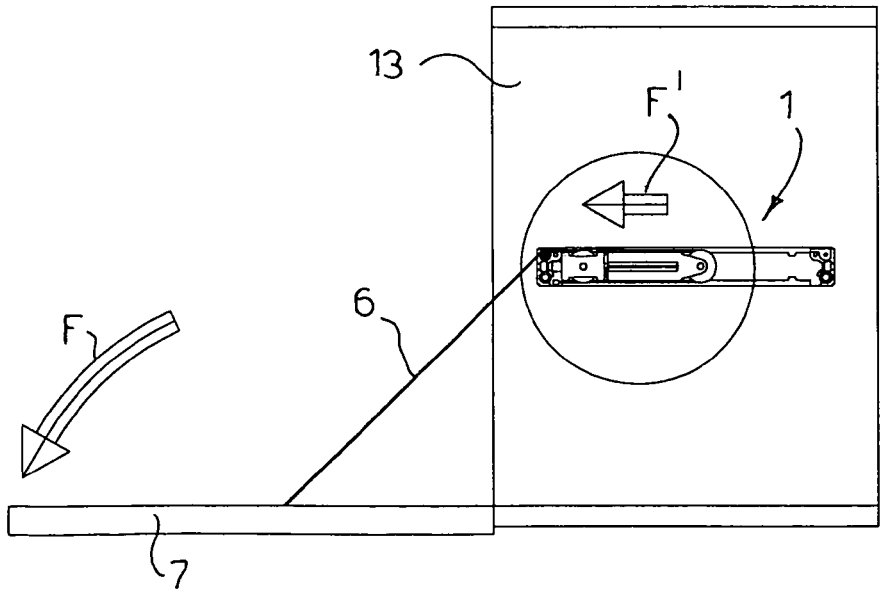
FIG. 2 shows diagrammatically the device of FIG. 1 applied to the inside wall of an item of furniture with the door open.

FIG. 2 shows diagrammatically the device 1 of FIG. 1 applied to the inside wall of an item of furniture 13 having the door 7 open; the device 1 can be seen more clearly in FIG. 3.

When the user opens the door 7 causing it to rotate in the direction of the arrow F (FIG. 2) and making the cable 6 to come out of the device 1, the second body 4 moves toward the first body 3 (arrow F', FIG. 3) compressing the spring 5 and (a little before the complete opening of the door 7, when the second body 4 is adjacent to the first body 3) the shock absorber 12.

The action of the spring 5 makes the opening of the door 7 more progressive and easier, since the compressed spring 5 counterbalances part of the weight of the door 7.

FIG. 4 shows diagrammatically the device 1 of FIG. 1, applied to the inside wall of an item of furniture 13 having the door 7 in the closing phase; the device 1 can be seen more clearly in FIG. 5.

When the user closes the door 7 making it rotate in the direction of the arrow F1 (FIG. 4), the spring 5, compressed, moves the second body 4 away from the first body 3 (arrow F1', FIG. 5) causing the cable 6 to return into the device 1 and making the closing of the door 7 easier and more gradual, since the force of expansion of the compressed spring 5 counterbalances part of the weight of the door 7.

The tension of the spring 5 at rest advantageously keeps the door 7 closed, preventing it from opening due to its own weight.

Without departing from the scope of the invention, a person skilled in the art can make to the guide and support device previously described all the changes and improvements suggested by normal experience and/or by the natural evolution of the art.

The invention claimed is:

1. A guide and support device in combination with an item of furniture having a door movably mounted thereon, comprising at least:

a support secured to the item of furniture;

said support having a first body mounted thereon near an outer end of said support, a second body slidably mounted on the support near an inner end thereof for movement between a first position near said first body and a second position away from said first body, and a spring disposed between said first body and said second body for urging said second body to said second position when the door is in a closed position;

said second body having a first pulley;

a cable having a first end secured to the door and a second end secured to said support, said cable extending around and being in slidable engagement with said first pulley between said first end and said second end thereof;

whereby upon opening of the door, said cable moves said second body toward said first position to compress said spring.

2. A device as in claim 1, wherein the support further carries an idler wheel for the cable near said first body.

3. A device as in claim 1, further comprising a covering element mounted on the support and having an opening for passage of the cable.

4. A device as in claim 3, wherein said support further carries an idler wheel for said cable near said first body, and the opening in said covering element for passage of the cable is positioned adjacent to said idler wheel.

5. A device as in claim 1, wherein said first pulley comprises at least two races, a second pulley comprising at least one race is mounted on said first body, and said cable extends from said first end thereof around one of the races of said first pulley, then around the one race of said second pulley, and then around the other of the races of said first pulley to said second end of said cable.

6. A device as in claim 5, wherein said second pulley comprises a second race, and said cable extends from said first end thereof through said second race of said second pulley before extending around one of the races of said first pulley.

7. A device as in claim 1, wherein said second body comprises a shock absorber that engages said first body when said second body moves to said first position upon the opening of the door.

8. A device as in claim 1, wherein said first body is adjustably mounted on said support, and said support comprises adjustment means for adjusting the position of said first body on said support.

9. A device as in claim 8 wherein said adjustment means comprise a screw, fixed to the support, which acts on a threaded bush integral with the first body.

10. A device as in claim 9, wherein the screw is a micrometric screw.

11. A device as in claim 1, wherein said spring is constructed to urge said door to a closed position and prevent it from opening due to its own weight.

12. A device as in claim 1, wherein the door is pivotally mounted on the item of furniture.

13. A device as in claim 1, wherein said second end of said cable is secured to said support near the outer end thereof.

* * * * *